US011602744B2

(12) United States Patent
Molitor et al.

(10) Patent No.: US 11,602,744 B2
(45) Date of Patent: Mar. 14, 2023

(54) PIPETTE WITH ADJUSTABLE DOSING VOLUME

(71) Applicant: Eppendorf AG, Hamburg (DE)

(72) Inventors: Peter Molitor, Hamburg (DE); Florian Tesch, Hamburg (DE)

(73) Assignee: Eppendorf AG, Hamburg (DE)

( * ) Notice: Subject to any disclaimer, the term of this patent is extended or adjusted under 35 U.S.C. 154(b) by 399 days.

(21) Appl. No.: 16/993,484

(22) Filed: Aug. 14, 2020

(65) Prior Publication Data

US 2021/0046471 A1 Feb. 18, 2021

(30) Foreign Application Priority Data

Aug. 15, 2019 (EP) ..... 19191903

(51) Int. Cl.
*B01L 3/02* (2006.01)

(52) U.S. Cl.
CPC ..... *B01L 3/0224* (2013.01); *B01L 2300/026* (2013.01)

(58) Field of Classification Search
CPC ..... B01L 3/0224; B01L 2300/026; B01L 3/0217; B01L 2200/12
USPC ..... 73/864.01, 864.13, 864.16, 864.18; 422/501, 516, 521, 522
See application file for complete search history.

(56) References Cited

U.S. PATENT DOCUMENTS 5,531,131 A 7/1996 Sabloewski
8,133,453 B2 3/2012 Molitor
2019/0083969 A1 3/2019 Schiraga et al.
2019/0083970 A1 3/2019 Schiraga et al.

FOREIGN PATENT DOCUMENTS

CA 2678346 A1 3/2010
CN 1901998 A 1/2007
DE 4335863 C1 2/1995
EP 0181957 A1 11/1984
(Continued)

OTHER PUBLICATIONS

CN Application No. 202010825171; filed Aug. 17, 2020; CN Office Action dated Nov. 3, 2021 (7 pages).
(Continued)

*Primary Examiner* — Robert R Raevis
(74) *Attorney, Agent, or Firm* — Barclay Damon LLP

(57) ABSTRACT

A pipette with an adjustable dosing volume comprises a housing connected to at least one seat configured to releasably hold a pipette tip. A displacement device is positioned within the housing and configured to aspirate and discharge liquid from the pipette tip. A stroke rod is coupled to the displacement element and configured to be longitudinally displaced relative to the housing to displace the displacement device. A catch sleeve is rotatably mounted within the housing and is connected to the stroke rod. An adjusting sleeve configured to engage a transducer shaft that is rotatably mounted within the housing and comprises a countershaft of a gearbox that is configured to be shifted between different shift stages. Each shift stage comprises different gear ratios between a rotational speed of the adjusting sleeve and a rotational speed of the catch sleeve. The different gear ratios enable coarse volume adjustment and fine volume adjustment.

20 Claims, 7 Drawing Sheets

(56) References Cited

FOREIGN PATENT DOCUMENTS

| | | | | |
|---|---|---|---|---|
| EP | 1743701 | A1 | 1/2007 | |
| EP | 2165765 | A1 | 3/2010 | |
| EP | 2329885 | A1 | 6/2011 | |
| FR | 3010518 | A1 | 3/2015 | |
| GB | 1597336 | | 9/1981 | |
| WO | 0161308 | A1 | 8/2001 | |
| WO | WO-2019060335 | A1 * | 3/2019 | ..... B01L 3/0224 |
| WO | WO-2019202246 | A1 * | 10/2019 | ..... B01L 3/0224 |

OTHER PUBLICATIONS

CN Application No. 202010825171; filed Aug. 17, 2020; English Translation of CN Office Action dated Nov. 3, 2021 (2 pages).
EP Application No. 19 191 903.4; filed Aug. 15, 2019; European Search Report dated Feb. 26, 2020 (5 pages).

* cited by examiner

Fig. 3.4
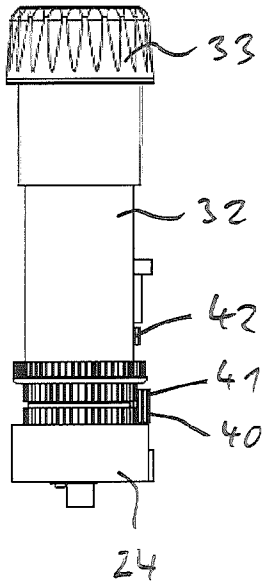
Fig. 3.3
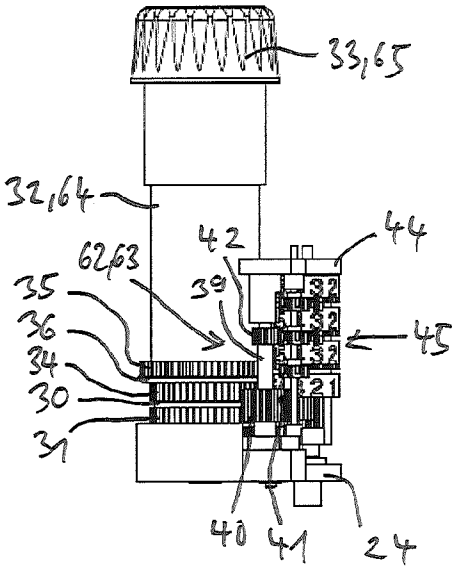
Fig. 3.2
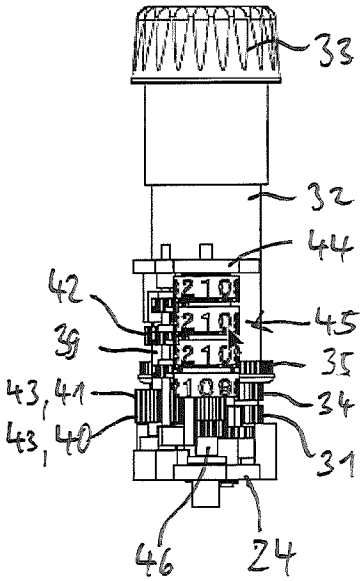
Fig. 3.1
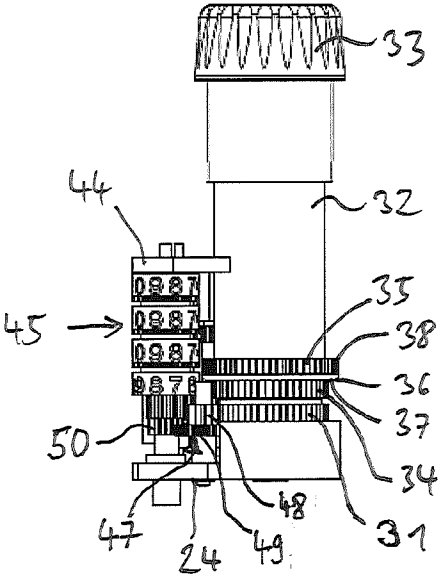

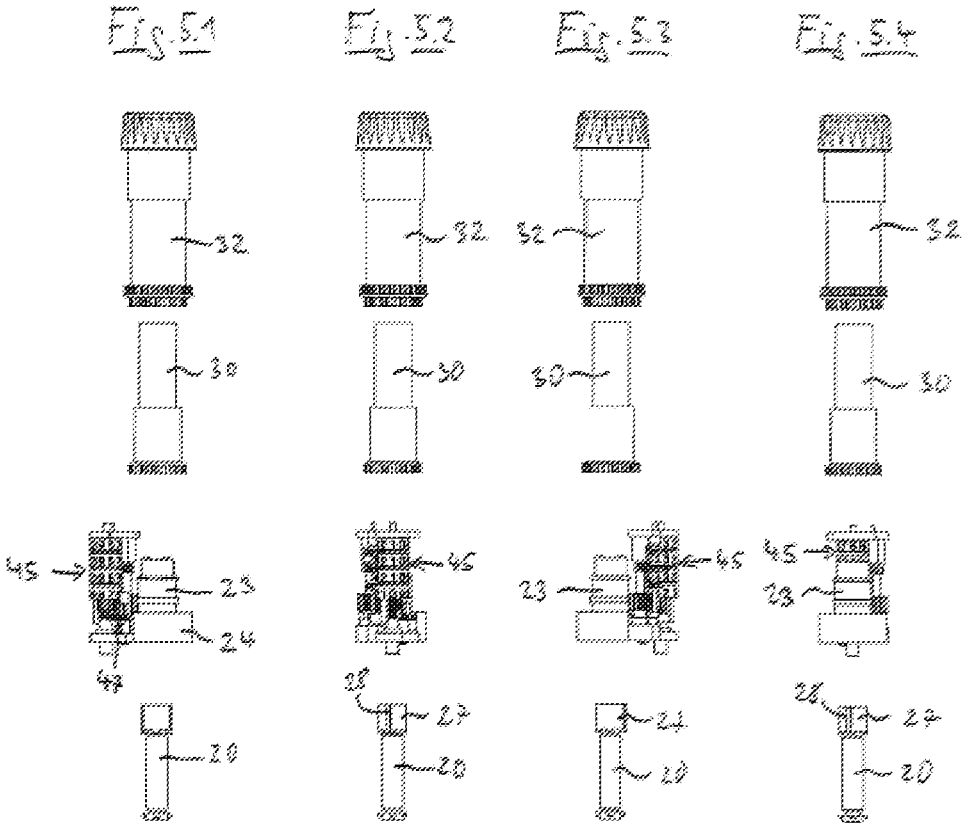
Fig. 5.1
Fig. 5.2
Fig. 5.3
Fig. 5.4
32
30
45
23
24
47
20
26
27
21

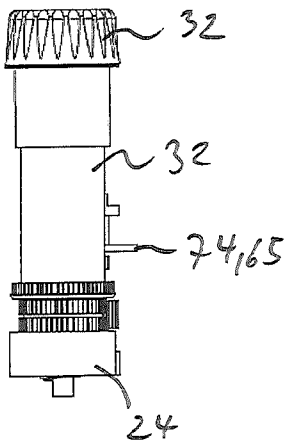
Fig. 7.4
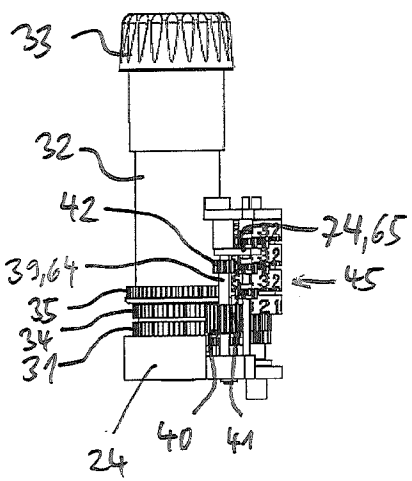
Fig. 7.3
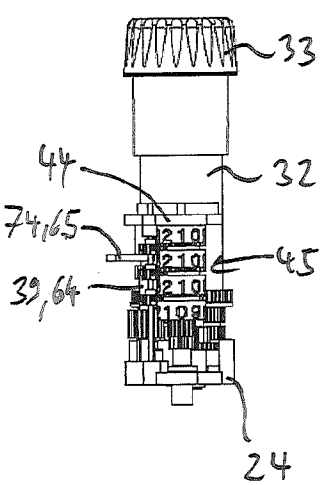
Fig. 7.2
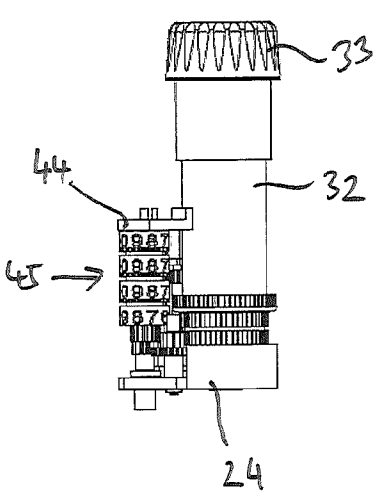
Fig. 7.1

Fig. 8.4
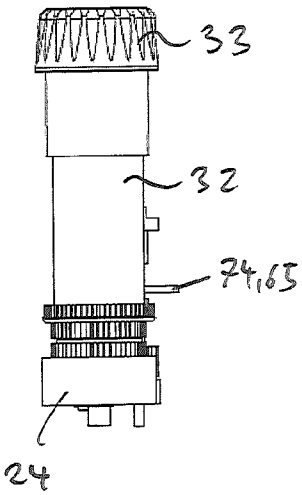
Fig. 8.3
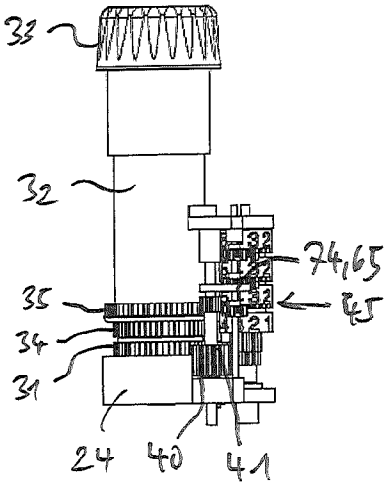
Fig. 8.2
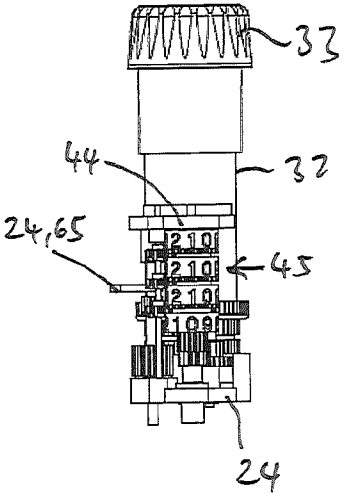
Fig. 8.1
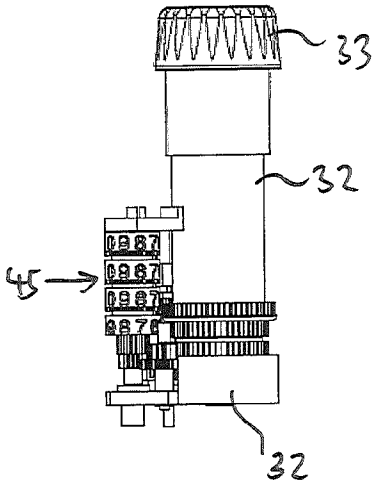

PIPETTE WITH ADJUSTABLE DOSING VOLUME

CROSS REFERENCE TO RELATED INVENTION

This application is based upon and claims priority to, under relevant sections of 35 U.S.C. § 119, European Patent Application No. 19 191 903.4, filed Aug. 15, 2019, the entire contents of which are hereby incorporated by reference.

BACKGROUND

The invention relates to a pipette with an adjustable dosing volume.

Pipettes are used in particular in laboratories for dosing liquids. For this purpose, a pipette tip is clamped securely by its upper end onto a seat of the pipette. The seat is generally a conical or cylindrical projection relative to a housing of the pipette on which a pipette tip can be clamped with a top opening of its tubular body. The pipette tip can draw up and dispense liquid through a lower opening of its tubular body. Air displacement pipettes comprise a displacement device for air that is connected to the pipette tip communicating through an opening in the seat. An air buffer is transferred by the displacement device so that the liquid is aspirated into, and discharged out of, the pipette tip. To accomplish this, the displacement device has a displacement chamber with a displaceable displacement element. The displacement device is typically a cylinder with a displaceable piston disposed therein.

After use, the pipette tip is detached from the seat, and exchanged for a fresh pipette tip. This can prevent contaminations through transferring the liquid in subsequent dosings. Generally, pipettes have an ejection device that allows pipette tips to be ejected by actuating a button without grasping the pipette tips. Single-use pipette tips generally consist of plastic.

The plunger is coupled to a drive device that serves to move the plunger in the cylinder. The drive device has a stroke rod that can be moved by a stop element between an upper and lower stop. At the beginning of drawing air into the cylinder, the stop element is located on the lower stop. At the beginning of displacing air out of the cylinder, the stop element is located on the upper stop. The amount of drawn and released liquid depends on the stroke of the stroke rod between the upper and lower stop.

In fixed volume pipettes, the distance between the upper and lower stop is constant. In pipettes with an adjustable dosing volume, the position of the upper stop is changeable. Known pipettes have an upper stop on the bottom side of a threaded spindle that can be adjusted in a spindle nut arranged fixedly within the housing. To adjust to the threaded spindle, adjusting devices are available that are coupled to display devices for displaying the adjusted dosing volume in the form of a counter.

DE 43 35 863 C1 and U.S. Pat. No. 5,531,131 describe a pipette in which an actuating button projects out of the housing at the top and is connected to the upper end of a stroke rod that is connected at the bottom end to the plunger. The stroke rod is guided through passage channels in a threaded spindle and a lower stop. It has a stop in the form of an outwardly projecting bead that limits the movement of the stroke rod between the upper stop at the bottom of the threaded spindle and the lower stop. By pressing the actuating element against the force of a return spring, the plunger is moved deeper into the cylinder until the stop element lies against the lower stop. After releasing the actuating element, the plunger returns to its home position as a result of the effect of the return spring in which the stop element lies against the threaded spindle. Adjusting devices for adjusting the threaded spindle have an adjusting sleeve rotatably mounted in the housing that projects out of the housing at the top and in which the actuating button is axially displaceable. The adjusting sleeve is connected to rotate conjointly with the threaded spindle by axial grooves in its inner circumference and by catches that project radially from the upper end of the threaded spindle. By rotating the adjusting sleeve, the threaded spindle with the upper stop and hence the dosing volume can be adjusted. The adjusting sleeve has a spur gear on the lower end that is coupled in a form fit by coupling devices to two coupling spur gears on a common shaft to a spur gear of a counter. By means of shifting devices, the shaft on which the two coupling spur gears are mounted can be displaced in order to disconnect coupling devices. This allows the pipette to be calibrated at the factory.

EP 1 743 701 B1 and U.S. Pat. No. 8,133,453 B2 describe a pipette of the above-described type which additionally has an adjusting device for adjusting the position of a holder holding the bottom stop relative to the cylinder and a display device for displaying the position of the holder. This makes it easier for the user to change the calibration and recover the factory calibration.

WO 01/61308 A1 describes a manually adjustable pipette that has a threaded rod that is non-rotatably coupled to a plunger rod for fine adjustment of the dosing volume, said threaded rod being displaceable in a nut that is non-rotatably arranged in the housing. In the upper end position of the plunger, a flange element on the plunger rod lies against the bottom side of the threaded spindle. For a quick adjustment of the dosing volume, the plunger rod is guided through an axially displaceable sleeve that bears the spindle nut at the bottom. A locking mechanism prevents an axial displacement of the sleeve in the locked position and, upon unlocking, releases the sleeve for a quick adjustment. The adjusted dosing quantity is ascertained by position sensors that detect the position of the plunger rod. At the upper end, the plunger unit bears a control button with which both the fine adjustment of the dosing volume as well as the drawing and discharging of liquid by means of a pipette tip are controlled. Consequently, the dosing volume may be altered while pipetting. Moreover the pipette is complex given the mechanical and electronic components.

U.S. 2019/0083969 A1 and U.S. 2019/0083970 A1 describe a quick adjusting mechanism for the dosing volume of a pipette. One type of design has a frame for being inserted in a housing of a pipette in which a planetary gear with an input shaft and an output shaft is arranged. A mode selector is coupled to the input of the planetary gear. The mode selector can be displaced between a direct drive position in which the planetary gear is disengaged so that the rotation of the input shaft causes a rotation at a 1:1 ratio of the output shaft of the planetary gear, and a speed amplifying position in which the planetary gear is engaged so that a rotation of the input shaft causes a rotation of the output shaft at multiple speed. Another type of design has a carrier for being inserted into a housing of a pipette on which there are a gear train with an input shaft, an output shaft and a shaft parallel thereto, a spur gearwheel on the input shaft, and a spur gearwheel on the parallel shaft engaging therewith, a spur gearwheel on the output shaft, and a spur gearwheel on the parallel shaft engaging therewith, as well as dog clutches between the two spur gearwheels on the input shaft and the output shaft and the two spur gears on the shaft parallel thereto. By coupling the input shaft and the output shaft, a direct drive is achieved in which the rotation of the input shaft at a 1:1 ratio is converted into a rotation of the output shaft. By engaging the other dog clutch, a speed multiplying state is achieved so that a rotation of the input causes a rotation of the output with a multiple speed. A disadvantage is the high structural complexity and the great space requirement since the quick adjusting mechanism occupies a longitudinal section in the housing of the pipette above a threaded spindle. Moreover, the adjustment of the dosing speed is limited in that, in the direct drive mode, the speed at the input shaft is the same as that of the output shaft.

The aforementioned disadvantages also occur with the pipette quick adjustment with a planetary gear.

BRIEF SUMMARY OF THE INVENTION

Against this backdrop, the object of the invention is to create a pipette that allows slow or fine adjustment of the dosing volume and a coarse or quick adjustment of the dosing volume with less structural complexity and a lesser space requirement.

An embodiment of a pipette with an adjustable dosing volume comprises a rod-shaped housing, at least one seat for releasably holding a pipette tip to a lower end of the housing and a displacement device comprising a displacement chamber fixedly arranged in the housing having a displacement element displaceable therein. A connecting channel connects the displacement chamber to an opening in the seat. A stroke rod is coupled at the bottom end to the displacement element and displaceable in the longitudinal direction in the housing and configured to displace the displacement element in the displacement chamber. A control button is connected to the upper end of the stroke rod and projects from the housing. A stop element is positioned on the outer circumference of the stroke rod. The pipette further includes a threaded spindle including a central spindle hole through which the stroke rod is guided and that has an upper stop at the bottom for the stop element. An inner thread is arranged in a fixed position within the housing in which the threaded spindle engages by an outer thread. A lower stop is arranged below the upper stop at a distance therefrom for the stop element. A catch sleeve is rotatably mounted in the housing that has at least one groove running in a longitudinal direction on the inner circumference in which at least one catch of the threaded spindle engages. A counter for displaying the dosing volume that is configured to detect the rotation of the catch sleeve. An adjusting sleeve is rotatably mounted in the housing. An adjusting element is accessible from the outside of the housing and connected to the adjusting sleeve. A transducer shaft is rotatably mounted in the housing and parallel to the adjusting sleeve and the catch sleeve. The adjusting sleeve has an input shaft, the catch sleeve has an output shaft, and the transducer shaft has a countershaft of a gearbox that is configured as a spur gearbox that has a shifting device with a shift element accessible from the outside of the housing. The gearbox is configured, by actuating the shift element, to shift various shift stages with different gear ratios between the rotational speed of the adjusting sleeve and the rotational speed of the catch sleeve.

Instead of an adjusting sleeve consisting of the aforementioned prior art that is connected so as to rotate conjointly with the threaded spindle and project by the upper end out of the housing in order to adjust the dosing volume, the pipette according to the invention comprises a catch sleeve connected to rotate conjointly with the threaded spindle, and an adjusting sleeve separate therefrom and rotatably mounted in the housing for adjusting the dosing volume. The adjusting sleeve forms a driveshaft, and the catch sleeve forms a driveshaft of a spur gear configured as a gearbox. This also has a transducer shaft serving as a countershaft which is arranged parallel to the adjusting sleeve and to the catch sleeve. The gearbox comprises a shifting device with which various shift stages can be shifted that have various gear ratios (transmission ratios) between the rotational speed of the adjusting sleeve and the rotational speed of the catch sleeve. For shifting, the shifting device comprises a shift element that is accessible from outside of the housing. Depending on which shifting stage is selected, the catch sleeve, and with it the threaded spindle, can be rotated faster or slower by rotating the adjusting sleeve with the same rotational speed. The rotation of the catch sleeve is detected and displayed by the counter. It is therefore possible to perform the adjustment of a dosing volume at two different speed levels. A fast speed level makes it possible to quickly roughly adjust the dosing volume, and a slow speed level makes it possible to easily and precisely adjust the dosing volume at the end of the adjusting process. The slight structural complexity of the adjusting mechanism is advantageous since the input shaft and output shaft of the spur gearbox replace the adjusting sleeve used up to this point and are not added as additional components. Another advantage is the small space requirement since the catch sleeve and the adjusting sleeve can be integrated in the adjusting mechanism. The catch sleeve accommodates the threaded spindle, and the adjusting sleeve can be shoved onto the catch sleeve. Consequently, an additional longitudinal section in the housing of the pipette does not have to be provided for the adjusting mechanism.

According to one embodiment, the adjusting sleeve or the catch sleeve on the outer circumference has a plurality of toothings with different diameters, the transducer shaft has a plurality of toothings with different diameters, and the shifting device is configured to connect the transducer shaft with the adjusting sleeve or catch sleeve in various shifting stages by various pairs of toothings. In this embodiment, the rotation in various shifting stages is transmitted by the transducer shaft. This embodiment enables transmission ratios that are less than 1:1. Consequently, the gearbox can be configured with a greater ratio between the largest and smallest transmission ratio (spread) than with a gearbox in which the input shaft and the output shaft are connected directly to each other in a direct gear and no rotation is transmitted by the countershaft. According to another embodiment, the gearbox is designed such that it cannot be shifted into a direct gear with a transmission ratio of 1:1. This can save structural complexity.

The "diameters of the toothings" is understood to be the diameter of the pitch cylinders or pitch circles whose midpoint falls within the midpoint of two engaging spur gears and that touch each other at the pitch point of the two spur gears. The pitch circle corresponds to the divided circle when the distance between two flanks on the pitch circle (pitch p) is determined by the standardized modulus $m=p:\pi$.

According to another embodiment, the shifting devices are configured to displace the adjusting sleeve and the transducer sleeve, or the transducer sleeve and the catch sleeve, in an axial direction relative to each other. According to this embodiment, at least one of the components of the adjusting sleeve, transducer shaft and catch sleeve can be displaced in an axial direction within the housing. According to another embodiment, the shifting device is an additional device that is coupled to at least one of the components of the adjusting sleeve, transducer shaft and catch sleeve in order to displace two of these components in an axial direction relative to each other. According to another embodiment, the adjusting sleeve or the transducer sleeve or the catch sleeve is simultaneously the shifting device or a component of the shifting device. In this embodiment, the adjusting sleeve or the transducer shaft or the catch sleeve is simultaneously used as a shifting device or as a component of a shifting device in order to shift various shifting stages of the gearbox.

According to another embodiment, the gearbox has a direct gear. In this embodiment, the gearbox has a shifting stage in which the input shaft is connected directly to the output shaft. In another shifting stage, the rotational movement of the input shaft is transmitted via the transducer shaft to the output shaft.

According to another embodiment, the gearbox is configured to comprise more than two shifting stages. For this purpose, additional toothings can be arranged on the adjusting sleeve and on the transducer shaft. The gearbox with more than two shifting stages can be a gearbox without a direct gear, or a gearbox with a direct gear.

According to another embodiment, the catch sleeve has a first toothing on the outer circumference, the adjusting sleeve has a second toothing on the outer circumference and a third toothing above the second toothing, wherein the second toothing has a different diameter than the third toothing. The transducer shaft has a fourth toothing engaging with the first toothing, thereabove a fifth toothing and thereabove a sixth toothing. The fifth toothing and the sixth toothing have different diameters, and the shifting device is designed to displace the adjusting sleeve and the transducer shaft in an axial direction relative to each other so that optionally, the second toothing can be brought into engagement with the fifth toothing, and the third toothing can simultaneously be brought out of engagement with the sixth toothing, or the third toothing can be brought into engagement with the sixth toothing and simultaneously the second toothing can be brought out of engagement with the fifth toothing. The transmission ratio between the rotational speed of the adjusting sleeve and the rotational speed of the catch sleeve can be altered. In this case, the first toothing is connected to rotate conjointly with the catch sleeve, the second and the third toothings are connected to rotate conjointly with the adjusting sleeve, and the fourth, fifth and the sixth toothings are connected to rotate conjointly with the transducer shaft. In this embodiment, a toothing of the adjusting sleeve is engaged with a toothing of the transducer shaft in different shifting stages. Depending on the shifting stage, different pairs of toothings are brought into engagement with each other. The rotation of the transducer shaft is transmitted by additional toothings to the catch sleeve. This creates different transmission ratios between the adjusting sleeve and the catch sleeve, and therefore between the threaded sleeve and the counter. The speed levels are determined by the toothings with different diameters on the adjusting sleeve, and toothings with different diameters on the transducer shaft. Depending on which pair of toothings of the adjusting sleeve and transducer shaft are in engagement, the threaded spindle is rotated more quickly or more slowly. According to another embodiment, the gearbox is configured such that it cannot be shifted into a direct gear with a transmission ratio of 1:1.

According to another embodiment, the fourth toothing has the same diameter and the same number of teeth as the fifth toothing. In this embodiment, the transmission ratio between the rotational speed of the adjusting sleeve and the rotational speed of the catch sleeve is 1:1 when the second toothing has the same number of teeth and the same diameter as the first toothing, and the second toothing engages with the fifth toothing.

According to another embodiment, the fourth toothing is simultaneously the fifth toothing. In this embodiment, the fourth toothing and the fifth toothing are combined into a single toothing. Consequently, the fourth toothing and the fifth toothing have the same diameter and the same number of teeth. The fourth toothing permanently engages with the first toothing, and the second toothing can also be brought into engagement with the fourth toothing that also forms the fifth toothing. So that the fourth toothing simultaneously engages with the first toothing and the second toothing, they are formed on a sufficient length of the transducer shaft. According to another embodiment, the fourth toothing and the fifth toothing are different toothings. The fourth toothing and the fifth toothing can be arranged at a distance from each other or directly border each other and have an offset in the circumferential direction relative to each other.

According to another embodiment, the fourth toothing and the fifth toothing have a different diameter. The fourth toothing and the fifth toothing can be arranged at a distance from each other or directly border each other, wherein a step is formed between the fourth toothing and the fifth toothing. As a consequence of the different diameters of the fourth toothing and the fifth toothing, the transmission ratio between the rotational speed of the adjusting sleeve and the rotational speed of the catch sleeve differs from 1:1 when the second toothing engages with the fifth toothing. This makes it possible to achieve transmission ratios below 1:1.

According to another embodiment, the fourth toothing and the fifth toothing have the same diameter and same number of teeth, and the first toothing and the second toothing have different numbers of teeth and the same diameter. This yields a profile shift in the circumferential direction between the profiles of the first toothing and the second toothing. Consequently, the adjusting sleeve and the catch sleeve have different rotational speeds when the second toothing engages with the fifth toothing. According to another embodiment, the number of teeth of the first toothing and the second toothing differ by one tooth. According to another embodiment, the second toothing has a greater number of teeth than the first toothing. This yields a transmission ratio between the rotational speed of the adjusting sleeve and the rotational speed of the catch sleeve below 1:1. This embodiment is more advantageous in terms of production than an embodiment in which the first toothing and the fifth toothing have different diameters.

According to another embodiment, the counter has a drive gear that engages in a first toothing on the outer perimeter of the catch sleeve. In this embodiment, the counter is mechanically driven. Preferably, the counter is a mechanical counter, in particular a roller counter. In another embodiment, the counter is an electromechanical counter or an electronic counter. The electromechanical counter or the electronic counter can also be controlled by electrical impulses that are generated by a sensor that detects the rotation of the catch sleeve. The rotation of the catch sleeve can also be directly detected by detecting the rotation of the threaded spindle. The "rotation of the catch sleeve" designates its position relative to a home position that can be indicated as the number of complete, or respectively partial rotations, or in angular degrees.

According to another embodiment, the adjusting sleeve is arranged concentrically to the catch sleeve. According to another embodiment, the adjusting sleeve is shoved onto the catch sleeve. This enables a particularly compact design.

According to another embodiment, the shifting device is designed to displace the adjusting sleeve in an axial direction relative to the housing to optionally bring the second toothing into engagement with the fifth toothing and simultaneously the third toothing out of engagement with the sixth toothing, or the third toothing into engagement with the sixth toothing, and simultaneously the second toothing out of engagement with the fifth toothing. Consequently, shifting of various shifting stages is enabled in that the adjusting sleeve is displaced somewhat out of the housing or into the housing. According to another embodiment, the shifting device is a shifting device coupled to the adjusting sleeve and designed separately therefrom, and which is configured to displace the adjusting sleeve in an axial direction. According to another embodiment, the adjusting sleeve is simultaneously the shifting device or a component thereof. In this embodiment, a section of the adjusting sleeve projecting out of the housing can be used as a shift element. By grasping the section and displacing the adjusting sleeve deeper into the housing or further out of the housing, the shift element can be actuated in order to shift the gearbox into different shifting stages. In this embodiment, the adjusting sleeve is used both for shifting different shifting stages as well as for adjusting the dosing volume.

According to another embodiment, the shifting device is configured to displace the transducer shaft in an axial direction relative to the housing to optionally bring the second toothing into engagement with the fifth toothing and simultaneously the third toothing out of engagement with the sixth toothing, or the third toothing into engagement with the sixth toothing, and simultaneously the second toothing out of engagement with the fifth toothing. This can prevent the dosing volume from being accidentally readjusted when shifting the gearbox or from unintentionally shifting the gearbox when adjusting the dosing volume. According to another embodiment, the shifting device is a shifting device coupled to the transducer shaft and designed separately therefrom which is configured to displace the transducer shaft in an axial direction. According to another embodiment, the transducer shaft is simultaneously the shifting device or a component thereof. According to another embodiment, a section of the transducer shaft or a shift lever coupled to the transducer shaft projects outside of the housing. A section of the transducer shaft or shift lever projecting out of the housing is a shift element that can be actuated from the outside in order to shift the gearbox into various shifting stages.

Another embodiment has a first spring device braced in the housing and against the stroke rod or the displacement element that holds the stroke rod in contact with the first stop when the control button with the stop element is released. This allows the stroke rod to be displaced independently upward after releasing the control button until the stop element lies against the upper stop. According to another embodiment, the stroke rod is displaced by means of the control button or another control element after reaching the lower stop, and possibly executing an overstroke until contacting the stop element on the upper stop.

According to another embodiment, the pipette has a device for adjusting a preferential position that adjusts the shifting device into a certain shifting stage. This allows the user to assume that the pipette is adjusted in a certain shifting stage before he or she uses it.

According to another embodiment, the device is for adjusting a preferential position of a second spring device.

According to another embodiment, the transducer shaft is arranged in a free space between the adjusting sleeve and the counter. According to another embodiment, the transducer shaft is arranged in a wedge-shaped free space between the adjusting sleeve and the counter. As a result, the required space of the adjusting mechanism is reduced.

According to another embodiment, the counter has counter rollers with a rotational axis parallel to the adjusting sleeve. According to another embodiment, the counter is a roller counter. According to another embodiment, the transducer shaft is arranged in a wedge-shaped free space between the counter rollers and the adjusting sleeve.

According to another embodiment, the adjusting element is an adjusting ring at the upper end of the adjusting sleeve. By rotating the adjusting ring, which is accessible from outside of the housing, the dosing volume can be adjusted. The adjusting ring on the upper end of the adjusting sleeve can simultaneously be the shift element of the shifting device.

According to another embodiment, the control button and the adjusting sleeve are connected to rotate conjointly by a device for connecting for conjoint rotation, and are connected with each other so as to be displaceable relative to each other in an axial direction so that the control button is simultaneously the adjusting element for adjusting the adjusting sleeve.

According to another embodiment, the shift element is a slide or switch actuatable from the outside of the housing. According to another embodiment, the displacement device comprises a displacement chamber designed as a cylinder and a displacement element designed as a plunger displaceable within the cylinder.

BRIEF DESCRIPTION OF THE DRAWINGS

The invention is explained in the following in more detail using the attached drawings of an exemplary embodiment. In the drawings:

FIG. 3.1 illustrates a right side perspective view of an embodiment of an adjustment mechanism of the pipette from the right side;

FIG. 3.2 illustrates a front perspective view of the embodiment of the adjustment mechanism of the pipette of FIG. 3.1;

FIG. 3.3 illustrates a left side perspective view of the embodiment of the adjustment mechanism of the pipette of FIG. 3.1;

FIG. 3.4 illustrates a rear perspective view of the embodiment of the adjustment mechanism of the pipette of FIG. 3.1;

FIG. 4.2 illustrates a front perspective view of the adjustment mechanism of FIG. 4.1;

FIG. 4.3 illustrates a left side perspective view of the adjustment mechanism of FIG. 4.1;

FIG. 4.4 illustrates a rear perspective view of the adjustment mechanism of FIG. 4.1;

FIG. 5.1 illustrates an exploded view of the adjustment mechanism of FIG. 4.1;

FIG. 5.2 illustrates an exploded view of the adjustment mechanism of FIG. 4.2;

FIG. 5.3 illustrates an exploded view of the adjustment mechanism of FIG. 4.3;

FIG. 5.4 illustrates an exploded view of the adjustment mechanism of FIG. 4.4;

FIG. 7.1 illustrates a right perspective view of another embodiment of an adjustment mechanism of the pipette;

FIG. 7.2 illustrates a front perspective view of the embodiment of the adjustment mechanism of FIG. 7.1;

FIG. 7.3 illustrates a left side perspective view of the embodiment of the adjustment mechanism of FIG. 7.1;

FIG. 7.4 illustrates a rear perspective view of the embodiment of the adjustment mechanism of FIG. 7.1;

FIG. 8.1 illustrates a right side perspective view of the adjustment mechanism of FIG. 7.1 shifted into a different shifting stage;

FIG. 8.2 illustrates a front perspective view of the adjustment mechanism of FIG. 8.1;

FIG. 8.3 illustrates a left side perspective view of the adjustment mechanism of FIG. 8.1; and FIG. 8.4 illustrates a front perspective view of the adjustment mechanism of FIG. 8.1.

DETAILED DESCRIPTION OF THE INVENTION

In the present application, the terms "top" and "bottom", "above" and "below", "plan view" and "bottom view" and terms derived therefrom such as "underside" and "bottom side" and "horizontal" and "vertical" relate to an alignment of the pipette in which the housing with the seat is aligned vertically downward. In this alignment, a pipette tip attached to the seat can be directed at a vessel located beneath it, in order to draw, or respectively dispense liquid.

Figure 1:
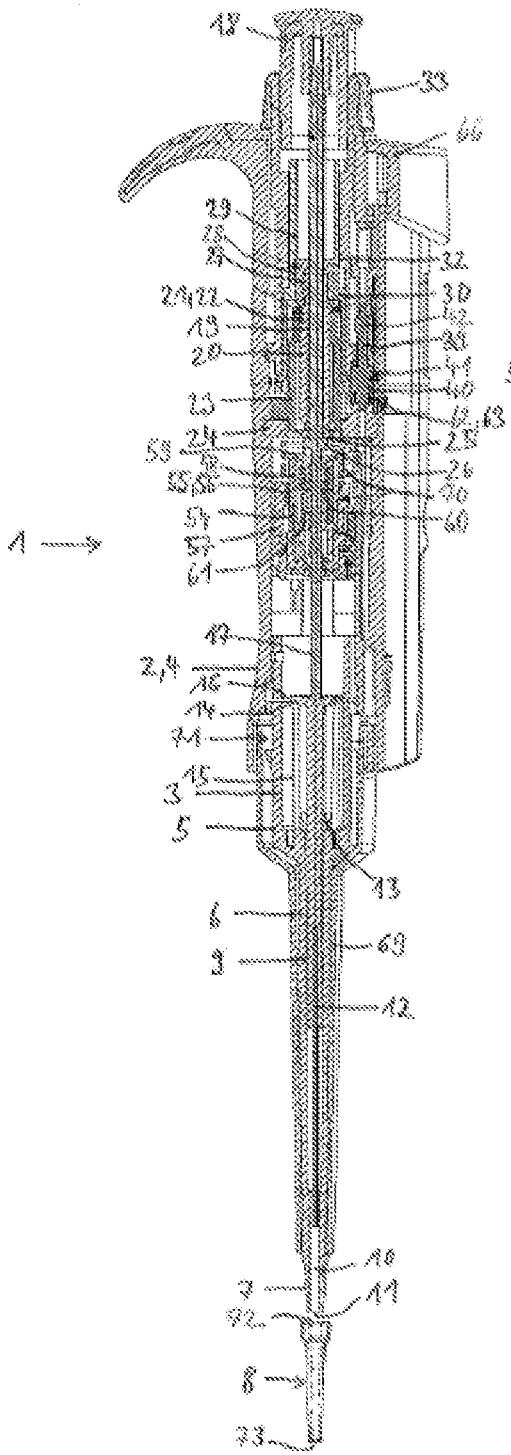
FIG. 1 illustrates a cross-sectional view of an embodiment of a pipette from the left side.
Figure 2:
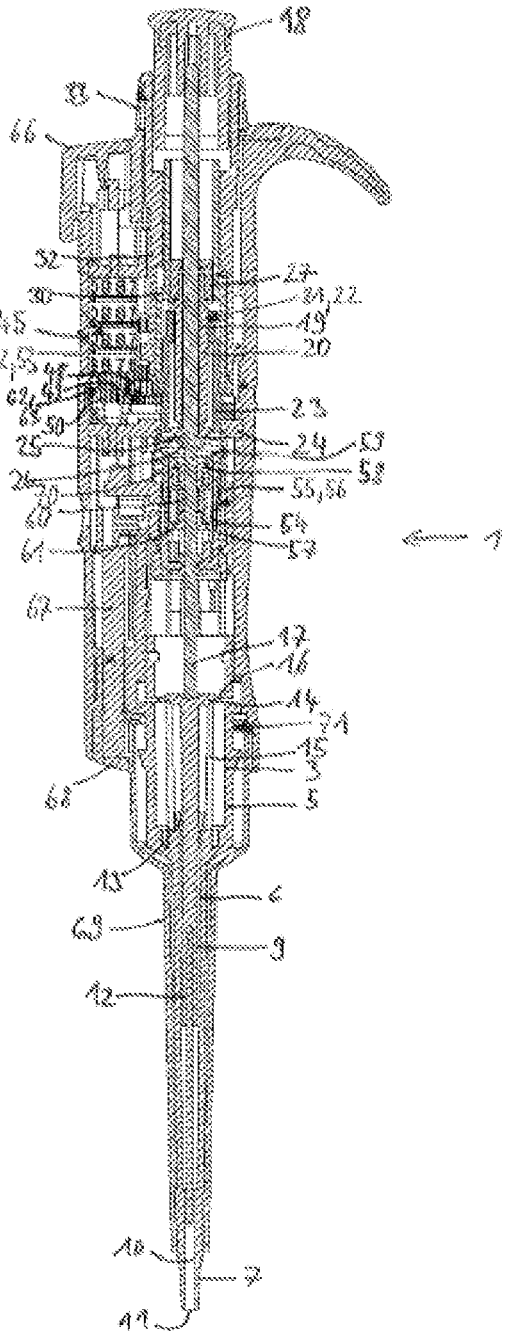
FIG. 2 illustrates a cross-sectional view of the embodiment of the pipette of FIG. 1 from the right side.

According to FIGS. 1 and 2, a pipette 1 according to the invention has a rod-shaped housing 2 with a bottom housing part 3 and an top housing part 4. At the top, the bottom housing part 3 has a tubular main body 5 with a conical floor from which a slim, tubular, slightly conical attachment 6 projects downward that has a seat 7 at the bottom for mounting a pipette tip 8. In the attachment 6, a displacement chamber 9 is formed in the form of a cylinder that is connected by a connecting channel 10 to an opening 11 in the bottom side of the seat 7.

Furthermore, the bottom housing part 3 comprises a displacement element 12 in the form of a plunger of the displacement device that is guided by a seal system 13 at the top side of the floor into the cylinder 11. The displacement element 12 has a plate 14 at the upper end that has a central dome-shaped recess in the top side. A first spring device 15 is arranged in the form of a helical spring between the plate 14 and the top side of the floor. The first spring device 15 presses the plate 14 from below against a sealing cap 16 that is connected to the main body 5 and has a passage in the center through which the plate 14 is accessible from above.

The top housing part 4 contains a stroke rod 17 that lies against the top side of the plate 14. The lower end of the stroke rod 17 engages in the recess in the plate 14. A control button 18 is fixed at the top to the stroke rod 17 and projects from the upper end of the housing 2 to the outside.

The stroke rod 17 is guided through a central spindle hole 19 in a threaded spindle 20 that is arranged in the top housing part 4. The threaded spindle 20 has an outer thread 21 on the outside that can be screwed into an inner thread 22 of a stroke body 23 that is held at the bottom to a first carrier 24 in the top housing part 4. The stroke body 23 forms a spindle nut.

The lower face of the threaded spindle 20 is an upper stop 25 for a stop element 26 in the form of an annular bead on the outer circumference of the stroke rod 17.

The threaded spindle 20 is connected at the upper end to rotate conjointly with a catch 27 that engages by means of ribs 28 projecting radially outward (see FIGS. 5.2 and 5.4) into axial grooves 29 of a catch sleeve 30. The catch sleeve 30 is arranged concentrically to the threaded spindle 20 and is rotatably mounted on the outer circumference of the stroke body 23. The catch sleeve 30 has a circumferential first toothing 31 on the bottom edge on the outer circumference. This is shown in particular in FIGS. 3.1-3.3 and 4.1-4.4.

An adjusting sleeve 32 is shoved onto the catch sleeve 30. The adjusting sleeve 32 is rotatably mounted on the outer circumference of the catch sleeve 30 and is displaceably guided in an axial direction between two barriers on the catch sleeve 30. The upper end of the adjusting sleeve 32 projects outward from the upper end of the housing 2. There, the adjusting sleeve 32 has an adjusting ring 33 on the outer circumference which bears a corrugation on the outer circumference.

The adjusting sleeve 32 has a second toothing 34 surrounding the outer circumference on the lower edge, and a third toothing 35 somewhat further upward surrounding the outer circumference. The first toothing 31 and the second toothing 34 have the same diameter and the same number of teeth. The third toothing 35 has a greater diameter and a greater number of teeth than the second toothing 34.

The second toothing 34 is closed on the top side, and the third toothing 35 is closed on the bottom side by an intermediate disc 36. The bottom side of the disc 36 forms a lower barrier 37, and the top side of the disc 36 forms an upper barrier 38 for the displacement of the adjusting sleeve 32.

On the first support 24, a transducer shaft 39 is rotatably mounted adjacent to the catch sleeve 30 and the adjusting sleeve 32. The transducer shaft 39 is provided at the bottom with a fourth toothing 40, above that with a fifth toothing 41, and above that with a sixth toothing 42. The fourth toothing 40 and fifth toothing 41 have the same diameter and the same number of teeth and are combined into a single toothing 43. The sixth toothing 42 is arranged at a distance from the fifth toothing 41 and has a smaller diameter and a lesser number of teeth than the fifth toothing 41. The transducer shaft 39 is rotatably mounted at the top in a second carrier 44 that is fixed in the top housing part 4.

As shown in FIGS. 3.1-3.4, a counter 45 in the form of a roller counter is held between the first carrier 24 and the second carrier 44. A counter roller shaft 46 of the roller counter is mounted at the bottom in the first carrier 24 and at the top in the second carrier 44. At the top, the second carrier 44 abuts a projection in the housing. In addition, a drive gear 47 is rotatably mounted on the first carrier 24 and comprises two spur gears 48, 49 with different diameters on a common shaft. The spur gear 48 with the smaller diameter meshes with the first toothing 31 of the catch sleeve 30, and the spur gear 49 with the larger diameter meshes with a drive pinion 50 on an initial roller of the roller counter.

Referring back to FIG. 1, the number wheels 51 of the counter 45 are visible from the outside of the housing 2 through a window 52 in the top housing part 4 that has a transparent cover 53 (FIG. 2). In the top housing part 4, a pot-shaped holder 54 is arranged below the stroke body 23.

The holder 54 has an outer thread 55 that is screwed into an inner thread 56 of a third carrier 57 fastened within the housing 2. The holder 54 contains a cap-shaped bottom stop 58 that is held below a downwardly-bent upper edge 59 of the holder 54. An overstroke spring 60 in the form of a helical spring that abuts the floor 61 of the holder 54 presses the bottom 58 against the upper edge 59. The stroke rod 17 is guided through central passages in the lower stop 58, through the overstroke spring 60 and a central passage in the floor 61 of the holder 54.

Figures 4A, 4B, 4C, 4D:
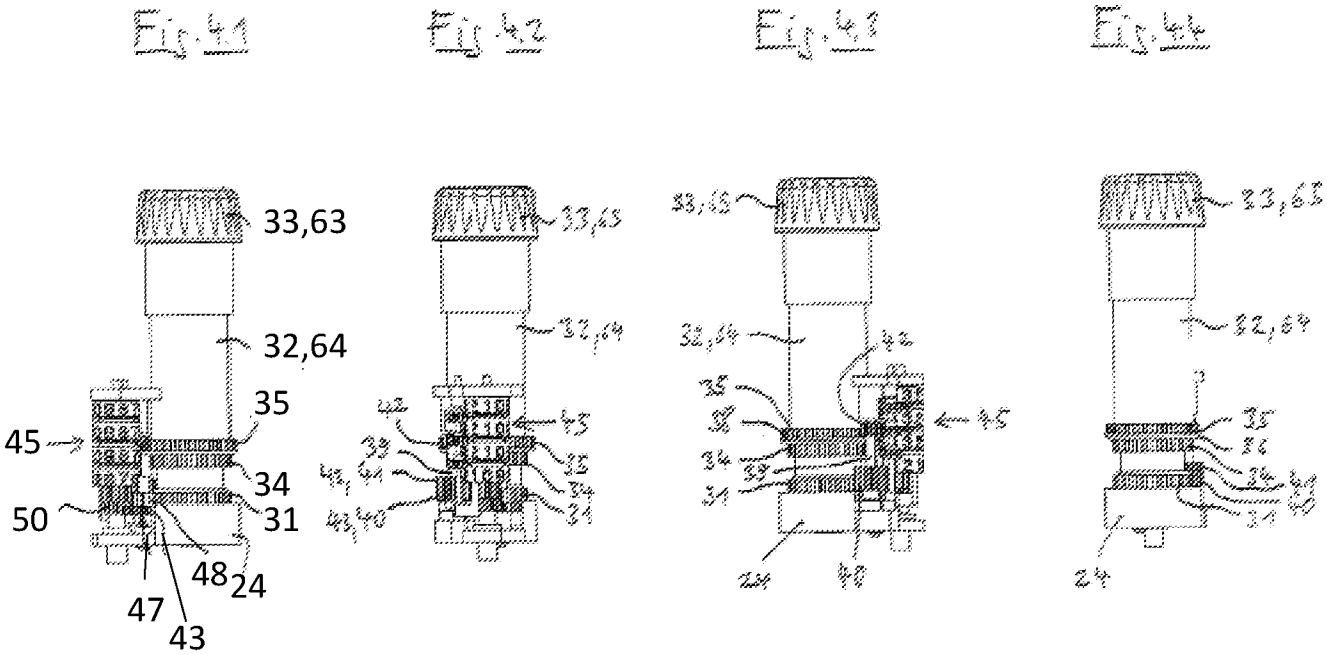
FIG. 4.1 illustrates a right side perspective view of the adjustment mechanism of FIG. 3.1 shifted into a different shifting stage.

The adjusting sleeve 32 is a driveshaft, the catch sleeve 30 is a driveshaft, and the transducer shaft 39 is a countershaft of a gearbox 63 designed as a spur gearbox 62. Shifting between the various stages is accomplished by axially moving the adjusting sleeve 32 into a lower shift position (fine adjustment position) shown in FIGS. 3.1-3.4 and 4.1-4.4, and into an upper shifting position (quick adjustment position) shown in FIGS. 4.1-4.4. In the fine adjustment position in FIGS. 3.1-3.4, the adjusting sleeve 32 is moved downward as far as possible until it contacts the lower barrier 37 on the top side of the fifth toothing 41, and in the quick adjustment position, the adjusting sleeve 32 is moved upward until it contacts the upper barrier 38 on the bottom side of the sixth toothing 42. The adjusting sleeve 32 is therefore simultaneously a switching shifting device 64 of the gearbox, wherein the adjusting ring 33 is a shift element 65 of the shifting device 64. In the exemplary embodiment, the gearbox 63 does not have any preferential position so that the gearbox always retains the last adjusted shifting stage. The invention includes other types of embodiments with a preferential position of the gearbox that for example are realized by means of a second spring device.

When the adjusting sleeve 32 is rotated, the catch sleeve 30 is also rotated corresponding to the adjusted shifting stage. By means of the catch sleeve 30, the threaded spindle 20 is screwed into the inner thread 22 fixed relative to the housing, and the upper stop 25 travels up or down depending on the rotational direction. This shifts the distance between the upper stop 25 and the lower stop 58 that determines the dosing volume. The set dosing volume can be read from the counter 45 which is driven via the drive gear 47 by the catch sleeve 30.

An ejector button 66 on an ejector rod 67 is seated next to the adjusting sleeve 32 at the top edge region of the top housing part 4. The ejector rod 67 runs parallel to the stroke rod 17 through the top housing part 4. Its bottom is connected to a lateral fastening shoulder 68 of the ejector sleeve 69 that is movably arranged on the attachment 6.

An ejector spring 70 configured as a helical spring is arranged in the top housing part 4, and one end is braced within housing 2 and the other end contacts the ejector rod 67. The ejector spring 70 presses the ejector rod 67 upward so that the ejector sleeve 67 lies against the attachment 6. The bottom housing part 3 and the top housing part 4 are connected to each other by a snap connection 71.

Before pipetting, the user can adjust the desired dosing volume. To accomplish this, he or she rotates the adjusting ring 33 until the desired dosing volume is displayed by the counter 45. To adjust the dosing volume, the user can choose between two speed levels. In particular when the last adjusted dosing volume deviates significantly from the dosing volume to be adjusted, the user can first select a quick shifting stage. If the gearbox is not already adjusted to the quick shifting stage, the user grasps the adjusting ring 33 and pulls the adjusting sleeve 32 out of the fine adjustment position in FIGS. 3.1-3.4 a bit more out of the housing 2 into the quick adjustment position shown in FIGS. 4.1-4.4.

In the first quick adjustment position, the first toothing 31 of the catch sleeve 30 engages with the fourth toothing 40 of the transducer shaft 39, and the third toothing 35 of the adjustment sleeve 32 engages with the sixth toothing 42 of the transducer shaft 39. This converts the rotational speed of the adjusting sleeve 32 into a higher rotational speed of the catch sleeve 30 so that the user can quickly adjust the dosing volume close to the dosing volume to be adjusted.

To precisely adjust the desired dosing volume, the user can choose a slow shifting stage. To accomplish this, he or she presses the adjusting sleeve 32 on the adjusting ring 33 lower into the housing 2 into the fine adjustment position shown in FIGS. 3.1-3.4. In this position, the first toothing 31 engages with the fourth toothing 40, and the second toothing 34 engages with the fifth toothing 41. Consequently, rotating the adjusting sleeve 32 at a certain rotational speed causes the catch sleeve 30 to rotate at a slower speed than in the quick shifting stage. With the toothings of the exemplary embodiment, the rotational speed of the adjusting sleeve 32 is the same as the rotational speed of the catch sleeve 30 since the first toothing 31 and the second toothing 34, as well as the fourth toothing 40 and the fifth toothing 41, each have corresponding numbers of teeth and diameters.

Before or after precisely adjusting the dosing volume, the user can clamp a pipette tip 8 onto the pipette 1 by pressing the pipette 1 by the seat 7 into the top opening 72 in the pipette tip 8. For pipetting, he or she first presses the control button 18 downward so that the stop element 26 is displaced by the top stop 25 against the bottom stop 58. In so doing, the stroke rod 17 presses the displacement element 12 downward, and the first spring device 15 is pretensioned. Then the user immerses the pipette tip 8 by its bottom opening 73 into the sample fluid and releases the control button 18. Consequently, the first spring element 15 presses the displacement element 12 and the stroke rod 17 upward until the stop element 26 lies against the upper stop 25. In so doing, a quantity of liquid is drawn into the pipette tip 8 corresponding to the adjusted dosing volume.

To discharge the quantity of liquid, the user holds the pipette tip 8 with the bottom opening 73 over another vessel and represses the control button 18 downward. After the bottom stop 58 is reached, he or she can press in the control button 18 deeper while overcoming the resistance of the overstroke spring 60 in order to eject a residual quantity of liquid from the pipette tip 8.

Then he or she can pipette an additional quantity of liquid in the same manner or, to change the sample liquid, the pipette tip 8 is ejected downward by pressing the ejector button 66. In so doing, the ejector sleeve 69 scrapes the pipette tip 8 off of the seat 7. After the ejector button 66 is released, the ejector spring 70 displaces the ejector rod 67 back to the shown home composition. Then additional pipettings can be carried out with the same adjusted dosing volume, or with a new dosing volume to be adjusted, wherein the adjustment can be performed as described above.

Figure 6:
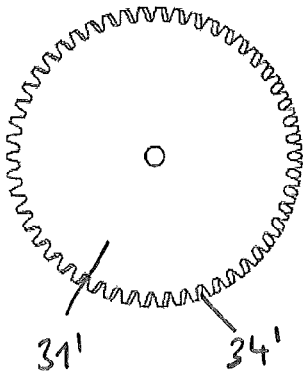
FIG. 6 illustrates a plan view of an embodiment of first and second toothings having a different number of teeth with the same diameters.

FIG. 6 shows the first and second toothing 31', 34' of another exemplary embodiment. This differs from the above-described in that the first toothing 31' and the second toothing 34' have the same diameter, wherein however the first toothing 31' has one tooth less than the second toothing 34'. Consequently the first toothing 31' has a greater pitch than the second toothing 34'. The plan view shows that as a consequence, there is a profile shift of the toothings between the first toothing 31' and second toothing 34'.

In this exemplary embodiment as well, the fourth toothing 40 and the fifth toothing 41 each have the same diameter and the same number of teeth. When the slow shifting stage is engaged, this causes the catch sleeve 30 to execute a bit less than one rotation for one rotation of the adjusting sleeve 32. Consequently, the rotational speed of the adjusting sleeve 32 is greater than the rotational speed of the catch sleeve 30. In the fast shifting stage, the catch sleeve 30 is rotated as in the above exemplary embodiment during a rotation of the adjusting sleeve 32. Overall, a somewhat larger spread of the transmission ratios is thereby achieved.

The adjusting mechanism in FIGS. 7.1-7.4 and 8.1-8.4 differs from the adjusting mechanism in FIGS. 3.1-3.4 and 4.1-4.4 in that the transducer shaft 39 that is a component of the shifting device 64, and not the adjusting sleeve 32, is held in an axially displaceable manner in the housing 2. Accordingly, two barriers prevent the displacement of the adjusting sleeve 32 in an axial direction. The displacement of the transducer shaft 39 in an axial direction is enabled in that its two ends engage in bearings in the first carrier 24 and in the second carrier 44 that permit a corresponding displacement.

A shift lever 74 that projects outward perpendicularly from the transducer shaft 39 is seated on the transducer shaft 39. The shift lever 74 is the shift element 65 of the shifting device 64. The shift lever 74 is held in a groove in the circumference of the transducer shaft 39. To accomplish this, the shift lever 74 is for example snapped onto the transducer shaft 39 for example with a fork-shaped end. The shift lever 74 engages in the ring groove such that, by displacing the shift lever 74 in an axial direction, the transducer shaft can be displaced up and down, and the transducer shaft 39 can be rotated relative to the shift lever 74. By an outer end, the shift lever 74 projects outward from a vertical slot in the housing 2 so that it can be displaced from the outside.

The downward displacement of the transducer shaft 39 is limited by contact with the bottom side of the fourth toothing 40 on the first carrier 24 (see FIGS. 8.1-8.4), and the upward displacement of the transducer shaft 39 is limited by contact with the shift lever 74 on the second carrier 44 (see FIGS. 7.1-7.4).

In FIGS. 7.1-7.4, the shifting device 64 is shifted into the fine adjustment position in which a rotation of the adjusting sleeve 32 causes a slow adjustment of the threaded spindle 20. In FIG. 8, the shifting device 64 is shifted into the quick adjustment position in which a rotation of the adjusting sleeve 32 causes a quick adjustment of the threaded spindle 20. Moreover, the adjusting mechanism in FIGS. 7.1-7.4 and 8.1-8.4 has the same properties as the adjusting mechanism in FIGS. 3.1-3.4 and 4.1-4.4.

The invention claimed is:

1. A pipette with an adjustable dosing volume comprising:

a housing comprising an upper end and an opposing lower end;

at least one seat connected to the housing and configured to releasably hold a pipette tip to the lower end of the housing;

a displacement device positioned within the housing and comprising, a displacement chamber fluidly connected to the at least one seat, and a displacement element configured to move within the displacement chamber to aspirate and discharge liquid from the pipette tip;

a stroke rod coupled to the displacement element and configured to be longitudinally displaced relative to the housing to displace the displacement element within the displacement chamber;

a control button configured to connect to the stroke rod to control movement of the stroke rod, wherein at least a portion of the control button projects from the housing;

a threaded spindle comprising at least one catch and defining a central spindle hole configured to guide the stroke rod;

a catch sleeve rotatably mounted within the housing and comprising an output shaft and at least one groove extending in a longitudinal direction that is configured to engage the at least one catch of the threaded spindle;

a counter configured to detect the rotation of the catch sleeve and display a dosing volume;

an adjusting sleeve rotatably mounted within the housing and comprising an input shaft;

an adjusting element accessible from an outside of the housing and connected to the adjusting sleeve; and a transducer shaft rotatably mounted within the housing and comprising a countershaft of a gearbox, wherein the gearbox comprises, a shifting device, and a shift element accessible from outside of the housing, wherein the shift element is configured to shift the gearbox between different shift stages, wherein each different shift stage comprises different gear ratios between a rotational speed of the adjusting sleeve and a rotational speed of the catch sleeve, and wherein the different gear ratios enable coarse volume adjustment and fine volume adjustment.

2. The pipette according to claim 1, wherein one of the adjusting sleeve and the catch sleeve include an outer circumference comprising a plurality of toothings with different diameters, wherein the transducer shaft comprises a plurality of toothings with different diameters, and wherein the shifting element is configured to cause the plurality of toothings of the transducer shaft to engage one of the plurality of toothings of the adjusting sleeve and the plurality of toothings of the catch sleeve.

3. The pipette according to claim 2, wherein the counter comprises a drive gear configured to engage a first toothing on the outer circumference of the catch sleeve.

4. The pipette according to claim 1, wherein:

the catch sleeve comprises a first toothing positioned on an outer circumference;

the adjusting sleeve comprises a second toothing on an outer circumference and a third toothing above the second toothing, wherein the second toothing has a different diameter than the third toothing; and the transducer shaft comprises a fourth toothing configured to engage with the first toothing, a fifth toothing positioned above the fourth toothing, and a sixth toothing positioned above the fifth toothing, wherein the fifth toothing and the sixth toothing have different diameters.

5. The pipette according to claim 4, wherein the shifting device is configured to displace the adjusting sleeve and the transducer shaft in an axial direction relative to each other to bring the second toothing into engagement with the fifth toothing, and wherein the third toothing is simultaneously disengaged from the sixth toothing.

6. The pipette according to claim 5, wherein the shifting device is configured to displace the adjusting sleeve and the transducer shaft in an axial direction relative to each other to bring the third toothing into engagement with the sixth toothing and simultaneously disengage the second toothing from the fifth toothing, and wherein the displacement of the adjusting sleeve and the transducer shaft alters the rotational speed of the adjusting sleeve and the rotational speed of the catch sleeve can be altered.

7. The pipette according to claim 6, wherein the fourth toothing has a same diameter and a same number of teeth as the fifth toothing.

8. The pipette according to claim 7, wherein the first toothing and the second toothing have a same number of teeth and a same diameter.

9. The pipette according to claim 7, wherein the first toothing the second toothing have a different number of teeth and a same diameter.

10. The pipette according to claim 6, wherein the fourth toothing and the fifth toothing have different diameters.

11. The pipette according to claim 4, wherein the shifting device is configured to displace the adjusting sleeve in an axial direction relative to the housing to bring the second toothing into engagement with the fifth toothing and simultaneously disengage the third toothing from the sixth toothing.

12. The pipette according to claim 11, wherein the shifting device is configured to displace the adjusting sleeve in the axial direction relative to the housing to bring the third toothing into engagement with the sixth toothing and simultaneously disengage the second toothing from the fifth toothing.

13. The pipette according to claim 4, wherein the shifting device is configured to displace the transducer shaft in an axial direction relative to the housing to bring the second toothing into engagement with the fifth toothing and simultaneously disengage the third toothing from the sixth toothing.

14. The pipette according to claim 13, wherein the shifting device is configured to displace the transducer shaft in an axial direction relative to the housing to bring the third toothing into engagement with the sixth toothing and simultaneously disengage the second toothing from the fifth toothing.

15. The pipette according to claim 1, further comprising a first spring device positioned within the housing and braced against one of the stroke rod and the displacement element.

16. The pipette according to claim 1, further comprising a second spring device configured to adjust the shifting device into a certain shifting stage.

17. The pipette according to claim 1, wherein the transducer shaft is positioned between the adjusting sleeve and the counter.

18. The pipette according to claim 1, wherein the counter comprises one or more counter rollers having a rotational axis that is parallel to the adjusting sleeve.

19. The pipette according to claim 1, wherein the adjusting element is an adjusting ring positioned at an upper end of the adjusting sleeve.

20. A pipette with an adjustable dosing volume comprising:

a housing;

at least one seat connected to the housing and configured to releasably hold a pipette tip;

a displacement device positioned within the housing and configured to aspirate and discharge liquid from the pipette tip;

a stroke rod coupled to the displacement device and configured to be longitudinally displaced relative to the housing to displace the displacement device;

a control button configured to connect to the stroke rod to control movement of the stroke rod, wherein at least a portion of the control button projects from the housing;

a threaded spindle defining a central spindle hole configured to guide the stroke rod;

a catch sleeve rotatably mounted within the housing and configured to engage the threaded spindle;

an adjusting sleeve rotatably mounted within the housing;

an adjusting element accessible from an outside of the housing and connected to the adjusting sleeve; and a transducer shaft rotatably mounted within the housing and comprising a countershaft of a gearbox, wherein the gearbox comprises, a shifting device, and a shift element accessible from outside of the housing, wherein the shift element is configured to shift the gearbox between different shift stages, wherein each different shift stage comprises different gear ratios between a rotational speed of the adjusting sleeve and a rotational speed of the catch sleeve, and wherein the different gear ratios enable quick volume adjustment and slow volume adjustment.

* * * * *